United States Patent [19]

Bischofberger et al.

[11] Patent Number: 4,670,632

[45] Date of Patent: Jun. 2, 1987

[54] HIGH-VOLTAGE SWITCH WITH A CLOSING RESISTOR

[75] Inventors: Walter Bischofberger, Niederweningen; Heinz Eichholzer, Thalwil; Werner Graber, Gippingen; Jiri Talir, Buchs; Edgar Hochspach, Wettingen; Werner Lüthi, Zürich, all of Switzerland

[73] Assignee: BBC Brown, Boveri & Company, Ltd., Switzerland

[21] Appl. No.: 842,474

[22] Filed: Mar. 21, 1986

[30] Foreign Application Priority Data

Mar. 27, 1985 [CH] Switzerland ..... 1338/85
Feb. 24, 1986 [CH] Switzerland ..... 724/86

[51] Int. Cl.[4] ..... H01H 33/16
[52] U.S. Cl. ..... 200/144 AP
[58] Field of Search ..... 200/144 AP

[56] References Cited

U.S. PATENT DOCUMENTS 3,763,340 10/1973 Noack ..... 200/144 AP
4,009,458 2/1977 Kishi et al. ..... 200/144 AP

*Primary Examiner*—Robert S. Macon

*Attorney, Agent, or Firm*—Ostrolenk, Faber, Gerb & Soffen

[57] ABSTRACT

The high-voltage switch with a closing resistor has a main switch point and, parallel to this, an auxiliary switch point, the closing resistor (19) being in series with the auxiliary switch point. A movable contact (17) of the auxiliary switch point is driven via a thrust-crank drive (16), in such a way that it closes before the main switch point and opens again after the main switch point has closed.

In this high-voltage switch, the object is to achieve a cycle of movement which, while ensuring a saving of components of the drive, can be adapted in a simple way to differing network conditions.

This is achieved because the thrust-crank drive (16) has a compressible joint (23), and because the movable contact (17) is coupled to two impact rings (34, 35) which interact with two stops (36, 37). When the auxiliary switch point is already closed, the first impact ring (34) strikes against the first stop (36), and the compressible joint (23) is guided from the first stable position beyond a dead center position into a second stable position. At the same time, the movable contact (17) moves somewhat in the opening direction and opens the auxiliary switch point.

11 Claims, 8 Drawing Figures

HIGH-VOLTAGE SWITCH WITH A CLOSING RESISTOR

Figure 1:
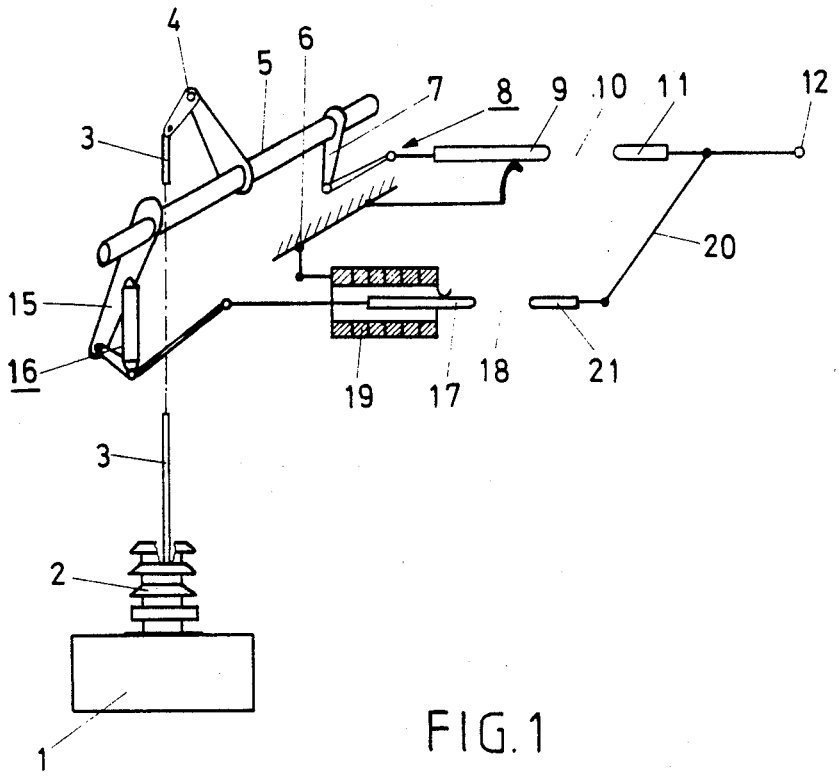

The present invention relates to a high-voltage switch with a closing resistor, according to the pre-characterising clause of claim 1.

German Offenlegungsschrift No. 3,132,821 has already made known a high-voltage switch, in which, parallel to the main switch point, there is a series connection between an auxiliary switch point and a closing resistor. The main switch point is actuated via a lever mechanism assigned to it, whilst a further lever mechanism acts on the movable contact of the auxiliary switch point. The lever mechanism assigned to the auxiliary switch point is designed in such a way that, when the circuit is closed, the auxiliary switch point always closes before the main switch point and then opens again after the main switch point has closed.

To achieve this cycle of movement of the auxiliary switch point, it is necessary to provide, in the associated lever mechanism, a multiplicity of parts which are only allowed to have very small production tolerances, since only in this way is it possible to prevent the lever mechanism from jamming. Parts produced with such precision are expensive.

The invention is intended to remedy this. The invention, as characterised in the claims, achieves the object of obtaining, in a high-voltage switch of the particular generic type, a cycle of movement which, whilst ensuring a saving of components in the drive, can be adapted in a simple way to differing network conditions.

The advantages achieved by means of the invention are to be seen essentially in that drive parts which are of simpler design and therefore more economical can be used. The production tolerances, which are always possible, are of little importance here. Furthermore, it is easily possible, by changing only one part, to modify the cycle of movement of the auxiliary switch point, so that the high-voltage switch can be adapted in this way to differing network conditions.

The dependent claims relate to further designs of the invention.

The invention is explained in detail below with reference to drawings illustrating only one possible embodiment.

Figure 2:
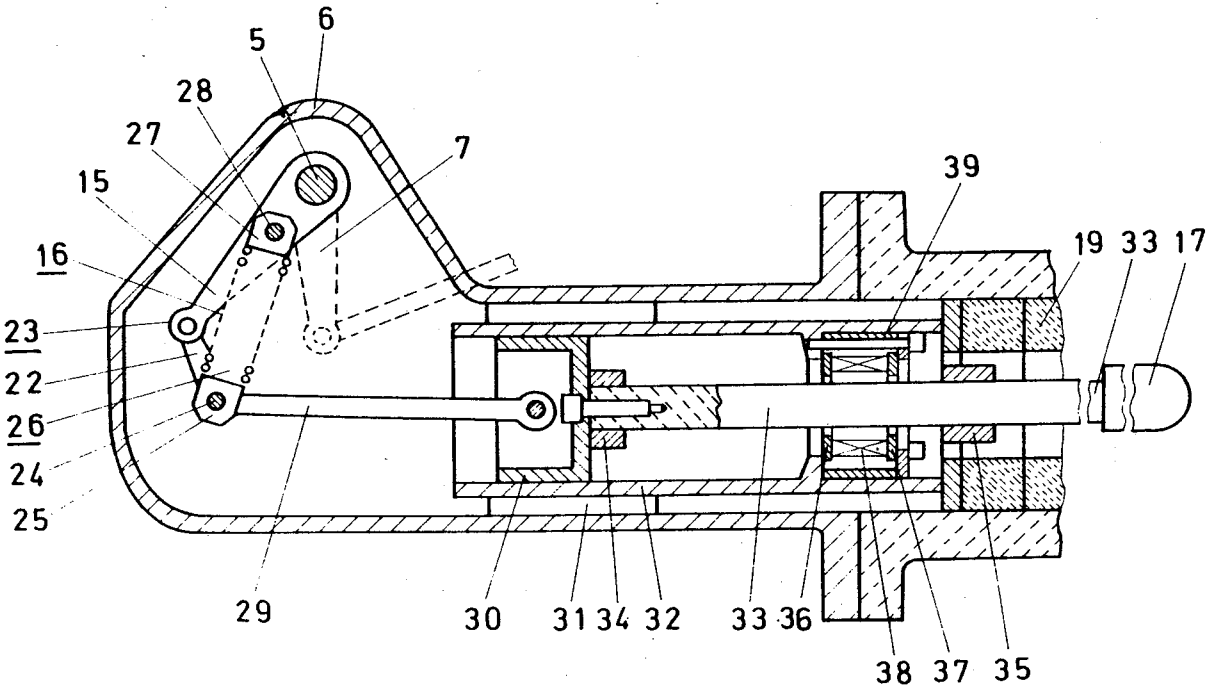
Figure 3:
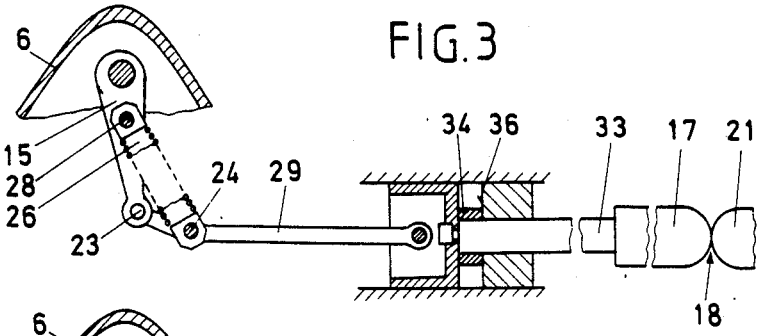
Figure 4:
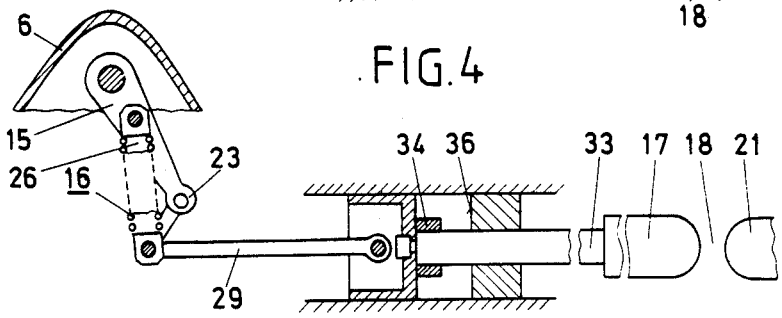
Figure 5:
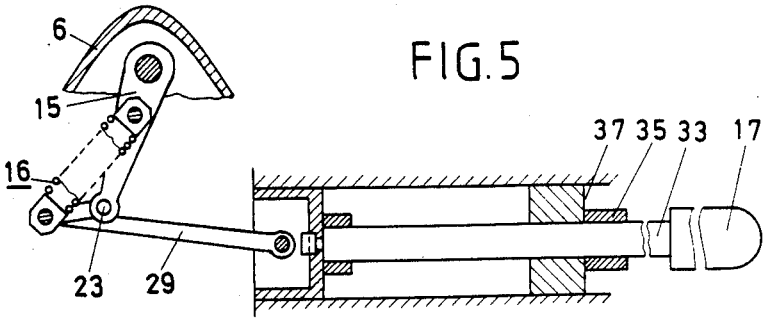
Figure 6:
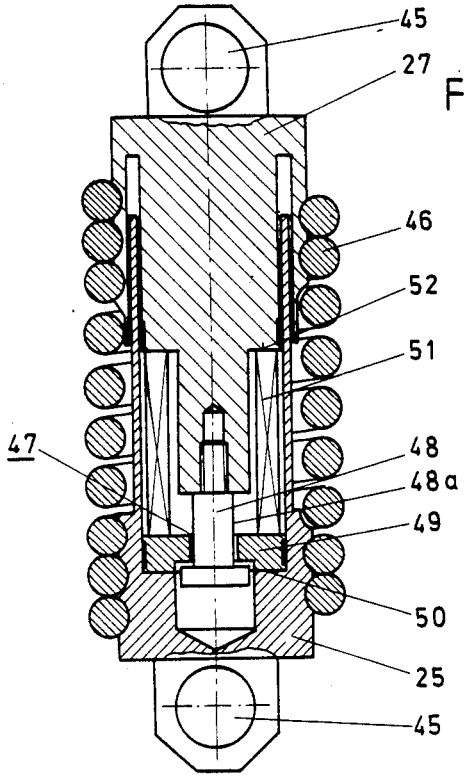
Figure 7:
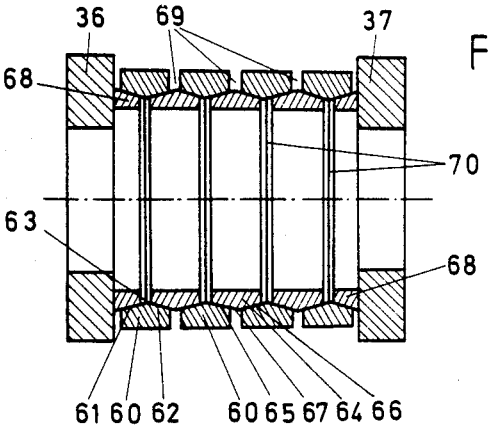
Figure 8:
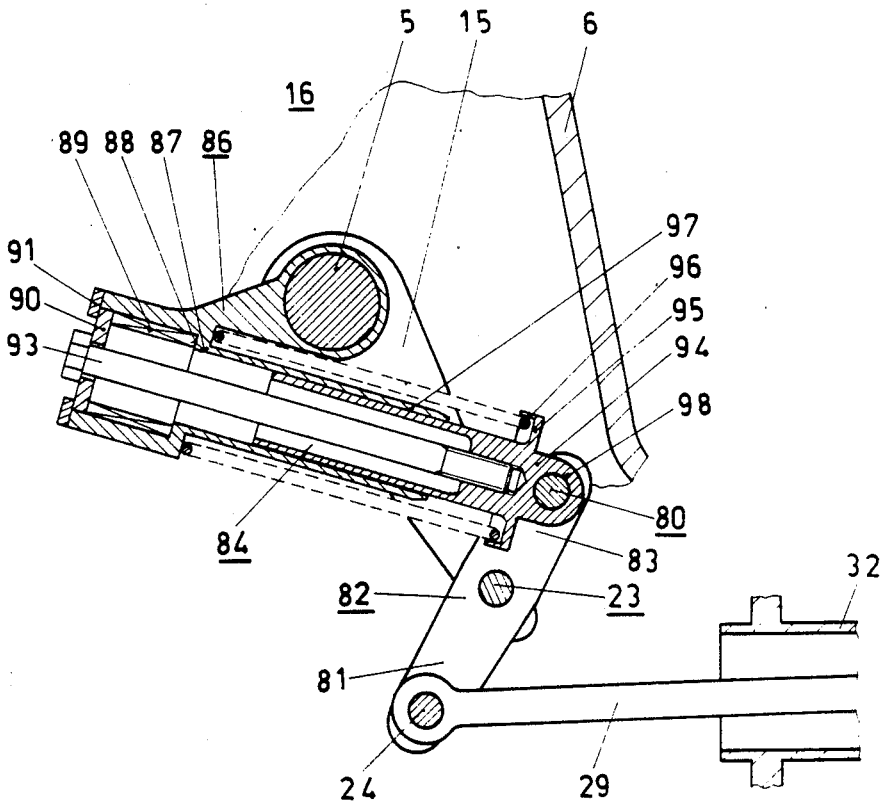

In the drawings:

FIG. 1 shows a diagrammatic representation of a first embodiment of a high-voltage switch according to the invention, FIG. 2 shows a section through the drive region of the auxiliary switch point in final cut-out state of the high-voltage switch according to FIG. 1, the drive elements of the main switch being represented by broken lines, FIG. 3 shows a greatly simplified section through the drive region, shown in FIG. 2, of the auxiliary switch point, with the movable contact of the auxiliary switch point being closed, FIG. 4 shows a greatly simplified section through the drive section, shown in FIG. 2, of the auxiliary switch point, with the high-voltage switch being in the final closed state, FIG. 5 shows a greatly simplified section through the drive region, shown in FIG. 2, of the auxiliary switch point, at the moment when its movable contact is opened to the maximum extent, FIG. 6 shows a section through a spring element of the drive region shown in FIG. 2, FIG. 7 shows a section through a friction-spring arrangement of the drive region shown in FIG. 2, and FIG. 8 shows a section through part of the drive region of an auxiliary switch point, in the final closed state, of a second embodiment of the high-voltage switch according to the invention.

In all the Figures, parts having the same effect bear the same reference symbols.

In FIG. 1, a drive 1 moves a shaft 5 via an insulating drive rod 3, guided through an insulator column 2, and via a lever arrangement 4. The shaft 5 is mounted in a conductive deflecting housing 6 which is merely indicated and which is supported on the insulator column 2. A rotary lever 7 fastened non-positively to the shaft 5 acts on a movable contact 9 of a main switch point 10 via a first thrust-crank drive 8. The movable contact 9 interacts with a fixed contact 11 connected to a current supply terminal 12. A lever 15 fastened non-positively to the shaft 5 moves a movable contact 17 of an auxiliary switch point 18 via a second thrust-crank drive 16. The auxiliary switch point 18 is connected electrically in series with a closing resistor 19, and this series connection is parallel to the main switch point 10. A flexible conductive connection 20 between the current supply terminal 12 and a fixed contact 21 of the auxiliary switch point 18 forms a parallel connection, whilst the other parallel connection is formed by the deflecting housing 6. The main switch point 10 and the series connection of the auxiliary switch point 18 and the closing resistor 19 are surrounded by insulating housing (not shown).

FIG. 2 shows the drive region of the auxiliary switch point 18, with the high-voltage switch in the final cut-out state. The lever 15 forms, together with an articulated lever 22, a compressible joint 23. The end of the lever 22 facing away from the lever 15 surrounds a hinge pin 24 and is connected via the latter to a first mounting 25 of a spring element 26. A second mounting 27 of the spring element 26 is connected to a fulcrum 28 located on the lever 15 adjacent to the shaft 5. Furthermore, articulated on the hinge pin 24 is one end of a connecting rod 29, the other end of which is connected in an articulated manner to a guide piece 30. This guide piece 30 slides in a cylindrical sleeve 32 connected to the deflecting housing 6 via ribs 31 and is connected rigidly to one end of an actuating rod 33 produced from bar-shaped or tubular insulating material. The other end of the actuating rod 33 passes through the perforated discs of the closing resistor 19 and is connected to the movable contact 17 of the auxiliary switch point 18.

Arranged firmly on the actuating rod 33 is a first impact ring 34 which is supported additionally on the guide piece 30. A second impact ring 35 is likewise fastened rigidly to the actuating rod 33. In the region between the impact rings 34, 35, two stops 36, 37 surround the actuating rod 33 concentrically. The two stops 36, 37 are supported, on sides located opposite one another, on a common laminated spring 38 which springs in the axial direction and which can be subjected to pressure on two sides, and are carried, together with this, by a mounting 39. The mounting 39 is fastened rigidly in the sleeve 32.

FIG. 6 shows a section through the spring element 26. Each of the two mountings 25, 27 has a fastening lug 45 and receives one end of a tension spring 46 which stresses the two mountings 25, 27 in the axial direction.

The mounting 25 partially surrounds the mounting 27 and guides the tension spring 46. The mounting 27 carries a damping device 47 which is fastened by means of a retaining screw 48. The retaining screw 48 holds a damper disc 49, in such a way that the latter can slide along its shank 48*a* in the axial direction. The damper disc 49 on the one hand is subjected to the spring force of the tension spring 46 by a shoulder 50 of the mounting 25 and on the other hand is supported on a laminated spring 51 and presses the latter against a shoulder 52 of the mounting 27.

FIG. 7 illustrates diagrammatically a cylindrical laminated friction spring which can be installed, for example, in the arrangements according to FIG. 2 (laminated spring 38) and FIG. 6 (laminated spring 51) between force-transmitting parts, such as, for example, the two stops 36, 37. The laminated friction spring consists of outer spring rings 60 and inner spring rings 64 which are stacked alternately on one another. Each outer spring ring 60 has internally conical chamfers 61, 62 which are identical from both sides and which meet in an edge 63. Each inner spring ring 64 has externally conical chamfers 65, 66 which are identical from both sides and which meet in an edge 67. The chamfers 61, 65 and 62, 66 fit exactly on one another when the laminated friction spring is stacked. End rings 68 corresponding to bisected inner spring rings 64 form the ends of the laminated friction spring. When the spring rings are stacked, gaps 69 remain between the shoulders of the outer spring rings 60 and gaps 70 remain between the shoulders of the inner spring rings 64. The sum of the gap distances represents the maximum spring excursion of the laminated friction spring.

To explain the mode of operation, FIG. 1 will be considered in more detail. The two thrust-crank drives 8, 16 are coupled rigidly via the shaft 5, the thrust-crank drive 16 being designed so that, when the switch is closed, the auxiliary switch point 18 is always closed first and cuts the closing resistor 19 into the current path. The current path then leads from the current supply terminal 12 via the flexible connection 20, the closed auxiliary switch point 18 and the closing resistor 19 to the deflecting housing 6, and from there usually further via an identical arrangement to a current outlet located on the other side of the high-voltage switch. After the main switch point 10 has closed, the auxiliary switch point 18 opens again immediately, and the current path then leads from the current supply terminal 12 directly to the deflecting housing 6 via the closed main switch point 10.

The closing cycle of the movable contact 17 of the auxiliary switch point 18 will be explained and compared with that of the movable contact 9 of the main switch point 10 by reference to FIG. 2. The length in the thrust-crank drive 16 which is effective for the movement of the movable contact 17 of the auxiliary switch point 18 is the centre-to-centre distance between the shaft 5 and the hinge pin 24. This length is substantially greater than the effective length of the rotary lever 7 provided for moving the main switch point 10. It proves advantageous to select a transmission ratio between the effective length of the rotary lever 7 and the effective length in the thrust-crank drive 16 in the region of 1:(1.4 to 1.8).

As soon as the closing action begins, starting from the position of the thrust-crank drive 16 shown in FIG. 2, the movable contact 17 of the auxiliary switch point 18 runs forward in the anti-clockwise direction before the movable contact 9 of the main switch point 10 because of the transmissison ratio higher than 1:1. The spring element 26 initially holds the levers 15 and 25 together in a first stable position, to ensure that the compressible joint 23 is not extended. The movable contact 17 of the auxiliary switch point 18 is at first in the "on" position and closes the current path, in which the closing resistor 19 is effective.

The selected transmission ratio is preferably 1:1.5, since this ensures that the auxiliary switch point 18 closes approximately 8 to 10 milliseconds before the main switch point 10. This interval is sufficient for most practical operating situations. However, it is easily possible to increase or reduce this interval by respectively lengthening or shortening the lever 15 in the region between the fulcrum 28 and the shaft 5, without other parts of the thrust-crank drive 16 having to be changed.

By increasing the interval, the load period of the closing resistor 19 is increased, as a result of which closing overvoltages in the network at the place of use of the high-voltage switch are reduced for a longer time and therefore to lower values. In networks designed to prevent high closing overvoltages from occurring, it is sufficient to damp these for a shorter time, so that the closing resistor 19 only has to take effect for a shorter time. In this case, provided that the mechanics ensure that the closing resistor 19 is in fact only subjected to loads for a comparatively short time, it can have correspondingly smaller dimensions and be cheaper.

FIG. 3 shows diagrammatically the moment of closing of the auxiliary switch point 18. The first impact ring 34 strikes against the first sprung stop 36 which damps the impact energy. The further movement of the hinge pin 24 in the closing direction is blocked via the connecting rod 29.

However, the lever 15 continues to be moved in the anti-clockwise direction by the drive of the highvoltage switch. Consequently, the compressible joint 23 is extended counter to the spring force of the spring element 26. This extending action continues up to a dead centre position which is defined when the axes of the fulcrum 28, the compressible joint 23 and the hinge pin 24 lie in one plane. Shortly before this dead centre position is reached, the main switch point 10 is likewise closed and the current now flows via this switch point.

After the dead centre position has been passed, the compressible joint 23, driven by the spring force of the spring element 26, tips over into a second stable position. Because it is tipped over in this way, a force is exerted on the connecting rod 29 in the cut-out direction and opens the auxiliary switch point 18. The lever 15 then still continues to move somewhat in the anti-clockwise direction, until the final conclusion of the closing operation. FIG. 4 shows the position of the thrust-crank drive 16, with the high-voltage switch in the final closed state. The distance between the impact ring 34 and the stop 36 shows that the contacts 17, 21 of the auxiliary switch point 18 are disengaged.

The opening action of the high-voltage switch begins, starting from the position of the thrust-crank drive 16 illustrated in FIG. 4. The lever 15 moves in the clockwise direction, and the distance between the contacts of the auxiliary switch point 18, which is already open, increases. Only now does the main switch point 10 open and break the circuit. Thus, the auxiliary switch point 18, which again leads the main switch point 10, during opening, because of the transmission ratio higher than 1:1, always has greater electric strength than the main switch point.

Towards the end of the opening movement, the thrust-crank drive 16 reaches the position shown in FIG. 5. Up to this position, the spring element 26 holds the compressible joint 23 in the second stable position. After the second impact ring 35 strikes against the sprung second stop 37, the further movement of the hinge pin 24 in the opening direction is blocked.

However, the lever 15 continues to be moved in the clockwise direction by the drive of the high-voltage switch. Consequently, the compressible joint 23 is again extended up to the dead centre position and, after the dead centre position has been passed, it tips back into the first stable position again as a result of the force originating from the spring element 26. Because it is tipped over in this way, the movable contact 17 of the auxiliary switch point 18 is moved somewhat in the closing direction. However, the lever 15 continues to move in the clockwise direction, until it reaches the final opening position shown in FIG. 2 and takes the movable contact 17 with it via the thrust-crank drive 16. Here again, because the compressible joint 23 tips over, the second impact ring 35 no longer rests against the second stop 37.

The functioning of the spring element 26 will be explained by reference to FIG. 6. When the tension spring 46 is extended as a result of forces exerted in opposite directions on the two lugs 45, the shoulder 50 lifts off from the damper disc 49. When the tension spring is suddenly relaxed, as occurs whenever the compressible joint 23 has tipped over, the shoulder 50 strikes against the damper disc 49, the force of the tension spring 46 determining the impact energy. The impact energy is damped by means of the laminated spring 51, so that the two mountings 25, 27 are protected against mechanical overloads.

A laminated friction spring such as that illustrated in FIG. 7 can advantageously be used where high impact energies have to be damped in the smallest possible space. When the stops 36, 37 are subjected to a mechanical load in the axial direction, the outer spring rings 60 and the inner spring rings 64 are pushed onto one another and expanded or compressed, and at the same time the gaps 69, 70 between the individual spring rings are reduced. The chamfers 61, 65 and 62, 66 rub intensively on one another, and as a result a large proportion of the impact energy is converted into frictional heat. Laminated friction springs work down to −50° C. without a loss of efficiency and are therefore particularly suitable for high-voltage switches installed in the open.

In an especially advantageous way, the region round the compressible joint 23 is made symmetrical, since this reliably prevents the arrangement from jamming. In a first constructive design, two levers 15 and two levers 22 are arranged parallel and the spring element 26 is fastened between them. In a second constructive design, a spring element 26 is provided on each side of a simple lever arrangement consisting of a lever 15 and a lever 22.

FIG. 8 shows a further embodiment of the thrust-crank drive 16, in which there is, in addition to the compressible joint 23, a further compressible joint 80 interacting with the latter. The compressible joint 23 has the lever 15 connected non-positively to the shaft 5 and a two-armed lever 82 articulated on the connecting rod 29 by means of an arm 81. The compressible joint 80 is formed by one arm 83 of the two-armed lever 82 and by a compression-spring element 84 which at one end is articulated on the two-armed lever 82 and at the other end is articulated on the shaft 5. The compression-spring element 84 has a housing part 86 with a central bore 87, the axis of which extends next to the shaft 5. A laminated spring 89 preferably containing friction springs is supported against a shoulder 88 of the central bore 87 and on the other side is retained by a disc 90 sliding in the central bore 87. A flange 91 connected to the housing part 86 secures the disc 90. A screw 93, which extends through a bore in a disc 90 and which can also be designed as a bolt, is screwed to a housing part 94 sliding telescopically in the central bore 87. The housing part 94 has a receptacle 95 for a compression spring 96, the other end of which is supported against the housing part 86. A sleeve-like part 97 of the housing part 86 guides the compression spring 96 on the inside. By means of the screw 93, the compression spring 96 can be prestressed according to the operating requirements. A lug 98 formed in the housing part 94 on the side facing away from the compression spring 96 allows connection to the compressible joint 80 to be made by means of a bolt.

It is advantageous, even in this embodiment, if the compression-spring element 84 is arranged between two parallel levers 15 and 82, since this reliably prevents the thrust-crank drive 16 from tilting and the bearing points from becoming worn on one side.

The mode of operation of the alternative form of the thrust-crank drive 16 illustrated in FIG. 8 is similar to that of the alternative embodiment already described with reference to FIGS. 2 to 5. In both alternative forms, the cycle of movement of the auxiliary switch point 18 is identical in the regions essential for the perfect functioning of the high-voltage switch. Only in the region round the particular dead centre of the thrust-crank drive 16 are there differences, since, in the alternative form according to FIG. 8, the actual dead centre is only reached after the extension of the compressible joint 23, that is only when the compressible joint 80 is extended. Consequently, the thrust-crank drive 16 can only tip over after the longitudinal axis of the central bore 87 of the compression-spring element 84 and the connecting line between the centres of the two compressible joints 23 and 80 run parallel to one another.

The alternative form described last is characterised, in particular, in that mechanical vibrations arising when the thrust-crank drive 16 moves away from the particular end position can be damped quickly. In this way, even a compression spring 96 of comparatively low mass can ensure an absolutely reliable operating behaviour of the thrust-crank drive 16. Another advantage arises because, as a result of the low-mass compression spring 96, the reaction forces on the two compressible joints 23 and 80 and the remaining bearing points can also be reduced, and this results in a longer service life of the arrangement and makes it possible to achieve a more economical construction.

We claim:

1. High-voltage switch with a closing resistor (19) and with at least one main and one auxiliary switch point (10, 18), the at least one auxiliary switch point (18) being in series with the closing resistor (19), and this series connection being connected in parallel with the at least one main switch point (10), and a movable contact (9, 17) of the at least one main switch point (10) and of the at least one auxiliary switch point (18) being actuable by respective thrust-crank drives (8, 16) driven via a common shaft (5), and the at least one auxiliary switch point (18) always closing before the at least one main switch point (10) and opening again immediately after the at least one main switch point (10) has closed, characterised in that the thrust-crank drive (16) acting on the movable contact (17) of the auxiliary switch point (18) has a first compressible joint (23), and in that the movable contact (17) of the at least one auxiliary switch point (18) is coupled to two impact rings (34, 35) which interact with two stops (36, 37), in such a way that, after the first impact ring (34) strikes against the first stop (36), this taking place when the auxiliary switch point (18) has closed, the first compressible joint (23) is guided from a first stable position beyond a dead centre position by the drive, and in such a way that, after a second impact ring (35) strikes against the second stop (37), this taking place towards the end of the opening action, the first compressible joint (23) is guided from a second stable position beyond a dead centre position by the drive.

2. High-voltage switch according to claim 1, characterised in that the first stop (36) and the second stop (37) are made resilient in the axial direction, and in that the two stops (36, 37) are supported, on sides located opposite one another, on a common laminated spring (38) which can be subjected to pressure on two sides.

3. High-voltage switch according to one of claims 1 or 2, characterised in that there is, in addition to the first compressible joint (23), at least one second compressible joint (80) interacting with the first (FIG. 8).

4. High-voltage switch according to one of claims 1 or 2, characterised in that the first compressible joint (23) has at least one first lever (15) fastened nonpositively on the shaft (5), at least one second lever (22) articulated on the connecting rod (29) and at least one spring element (26) which is articulated on the two levers (15, 22) (FIG. 2).

5. High-voltage switch according to claim 4, characterised in that the spring element (26) has a tension spring (46) and a damping device (47) with a laminated spring (51).

6. High-voltage switch according to claim 5, characterised in that one end of the tension spring (46) is fastened by means of a first mounting (25) to a hinge pin (24) which connects the second lever (22) to the connecting rod (29), and in that its other end is coupled by means of a second mounting (27) to a fulcrum (28) of the first lever (15) arranged adjacent to the shaft (5).

7. High-voltage switch according to claim 6, characterised in that the first mounting (25) serves as a guide part for the tension spring (46) and partially surrounds the second mounting (27) which carries the laminated spring (51) of the damping device (47).

8. High-voltage switch according to claim 3, characterised in that the first compressible joint (23) has at least one first lever (15) fastened non-positively on the shaft (5) and at least one two-armed lever (82) which is articulated on the first lever (15) and the first arm (81) of which is articulated on a connecting rod (29) and in that the second compressible joint (80) is formed by a second arm (83) of the at least one two-armed lever (82) and by a compression-spring element (84) which at one end is articulated on the two-armed lever (82) and at the other end is articulated on the shaft (5).

9. High-voltage switch according to claim 8, characterised in that the compression-spring element (84) is formed by two housing parts (86,94) sliding telescopically in one another and by a compression spring (96) supported on the two housing parts (86, 94).

10. High-voltage switch according to claim 9, characterised in that there is supported on one (86) of the housing parts (86, 94) a laminated spring (89) which damps the movement of the other (94) of the housing parts.

11. High-voltage switch according to claim 10, characterised in that the first housing part (86) supporting the laminated spring (89) has a displaceable disc (90) supported on the laminated spring (89) and having an orifice, through which is guided a bolt connected non-positively to the other housing part (94) and interacting with the disc (90).

* * * * *